US005762346A

United States Patent [19]

Conte

[11] Patent Number: 5,762,346

[45] Date of Patent: Jun. 9, 1998

[54] IN-LINE ROLLER SKATE WITH ADJUSTABLE WHEELS

[75] Inventor: Gino Conte, Caerano San Marco, Italy

[73] Assignee: Roces S.R.L., Italy

[21] Appl. No.: 667,423

[22] Filed: Jun. 21, 1996

[30] Foreign Application Priority Data

Jul. 5, 1995 [IT] Italy ..... MI95A1433

[51] Int. Cl.[6] ..... A63C 17/06

[52] U.S. Cl. ..... 280/11.22; 280/11.27

[58] Field of Search ..... 280/11.22, 11.27, 280/11.28, 11.23

[56] References Cited

U.S. PATENT DOCUMENTS

| | | | |
|---|---|---|---|
| 2,412,290 | 12/1946 | Rieske . | |
| 3,287,023 | 11/1966 | Ware . | |
| 5,046,746 | 9/1991 | Gierveld . | |
| 5,048,848 | 9/1991 | Olson et al. . | |
| 5,253,884 | 10/1993 | Landers . | |
| 5,366,232 | 11/1994 | Pozzobon et al. | 280/11.22 |
| 5,385,356 | 1/1995 | Conte | 280/11.22 |
| 5,585,658 | 12/1996 | Perner et al. | 280/11.27 |
| 5,586,777 | 12/1996 | Wolf | 280/11.27 |
| 5,630,624 | 5/1997 | Goodman | 280/11.22 |

FOREIGN PATENT DOCUMENTS

| | | |
|---|---|---|
| 1274289 | 7/1997 | Italy . |
| 94-26367 | 11/1994 | WIPO . |

*Primary Examiner*—Thomas J. Brahan
*Attorney, Agent, or Firm*—R. Neil Sudol; Henry D. Coleman

[57] ABSTRACT

An in-line roller skate with adjustable wheels includes a U-shaped frame (2) having first wings (3a, 3b) supporting two first wheels (5a, 5b) there between. On the first wings, between the two first wheels, there is a pair of first longitudinal seats for selectively coupling two complementarily shaped supports (13a, 13b). Second seats for two second wheels (18a, 18b) are formed on the supports, eccentrically with respect to the longitudinal median axis of the skate. The particular coupling of the two supports to the two first longitudinal seats allows to pivot the second wheels along either the same plane of the first wheels, or a different one.

12 Claims, 4 Drawing Sheets

14b
16b
13a 23
22
13b
14a
16a
9b
3b
2
10b
10a
3a
9a
16a
13a
14a
17a
21
20a
19a
13a
14b
16b
15b
14a
16a 14b
10b
16b
15a
15b
13
14a
16a
10a

IN-LINE ROLLER SKATE WITH ADJUSTABLE WHEELS

BACKGROUND OF THE INVENTION

1. Field of the invention

The present invention relates to an in-line roller skate with adjustable wheels.

2. Description of the Prior Art

Conventional roller skates with in-line wheels comprise a generally U-shaped frame associated with a boot shell and supporting a plurality of in-line wheels.

A problem in the use of these skates is that it is not always easy to achieve quick changes of direction, due to the in-line arrangement of the wheels, which can even be four or five.

This problem leads to the need for the user to technically have two structurally different skates available, depending on whether he must for example perform slalom or a speed race.

U.S. Pat. No. 2,412,290 offers a partial solution to this drawback and discloses a skate that has a frame with three in-line wheels, the intermediate wheel is vertically adjustable to facilitate skate maneuverability.

However, this solution is structurally complicated, because vertical adjustment of the intermediate wheel is achieved by means of a fixing bolt and a system of meshing teeth to provide the desired vertical adjustment.

U.S. Pat. No. 3,287,023 discloses a roller skate whose frame includes, at the rear and front parts, seats at different elevations for the positioning of the rear and front wheels, which can thus be more or less spaced from the ground.

However, even this solution is not ideal, because in order to vary the arrangement of the wheels it is necessary to disconnect them from the frame and to reposition the wheels in the desired point.

This operation is long and entails the risk of losing a component as the user first disassembles the wheels and then reassembles them.

U.S. Pat. No. 5,048,848 discloses an in-line roller skate provided with bushes for axial openings for the purpose of simplified installation. Two pairs of separate slots, whose axis is perpendicular to the ground, are in fact formed on the wings of the frame of the skate transversely to the wings themselves. Four complementarily shaped bushes can be temporarily positioned inside the two pairs of slots and are provided with eccentric holes that act as seats for the pivots of the central wheels. The arrangement of these four bushes, in positions that are mutually rotated through 180°, within these slots allows to position the central wheels at a slightly lower elevation than the front and rear ones, so as to improve turning.

However, even this solution is not free from drawbacks: first of all, to vary the elevation of the central wheels it is necessary, for each wheel, to disengage the two bushes from the respective openings, turn them, reposition them in the openings, place the wheel back in position, insert the pivot again, and lock it. Therefore, if the user wished to vary the elevation of the position of the two central wheels, he would have to perform several maneuvers that increase the time required to complete the operation, with the additional possibility of losing or misplacing bushes, bolts, and pivots during these operations.

SUMMARY OF THE INVENTION

The aim of the present invention is to solve the described technical problems, eliminating the drawbacks of the known art and thus providing a skate with in-line wheels that can be used both for speed skating and for slalom, in which easier turning on sharp curves is required.

Within the scope of this aim, an important object is to provide a skate in which the configuration for speed skating or for slalom can be achieved very quickly and simply.

Another important object is to provide a skate in which the operation for varying the configuration minimizes the possibility of losing the components of the skate.

Another important object is to provide a skate that associates with the preceding characteristics that of being reliable and safe in use.

Another object is to provide a device that has low production costs and may be produced with conventional machines and equipment.

This aim, these objects, and others which will become apparent hereinafter are achieved by an in-line roller skate with adjustable wheels as claimed in the appended claims.

Further objects will become apparent from the following description, which must be considered together with the accompanying drawings, which illustrates, by way of non-limitative example, a particular embodiment.

DESCRIPTION OF THE PREFERRED EMBODIMENTS OF THE INVENTION

Figure 1:
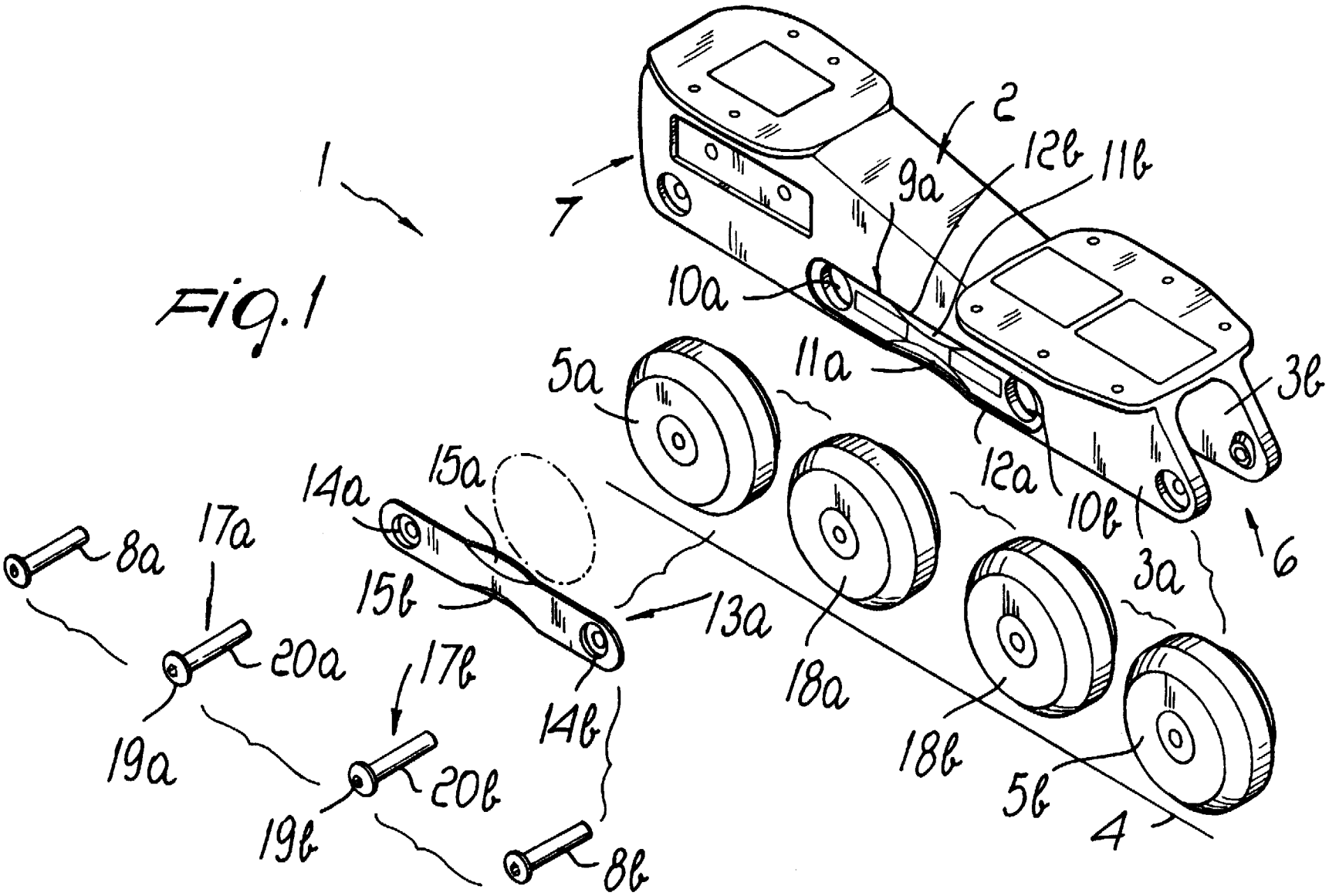
FIG. 1 is an exploded perspective view of a skate according to the invention.
Figure 2:
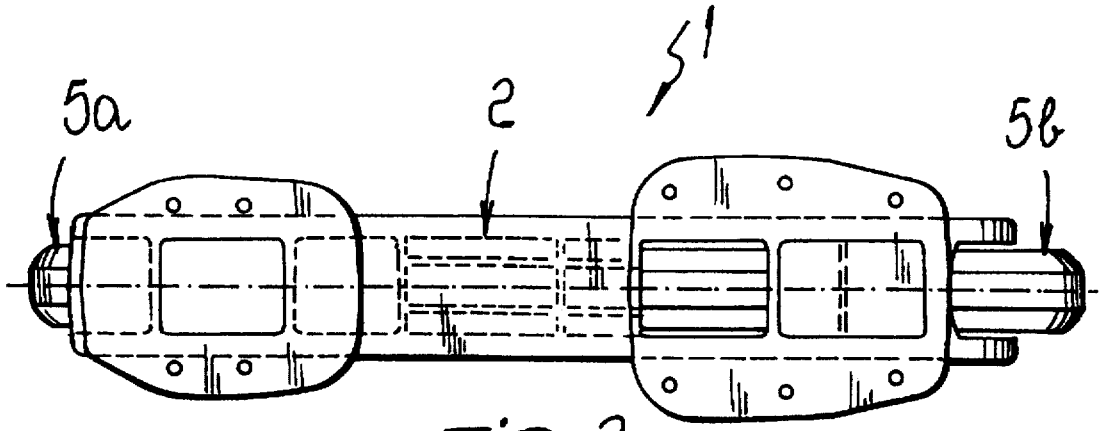
FIG. 2 is a top plan view of the skate of FIG. 1.
Figure 3:
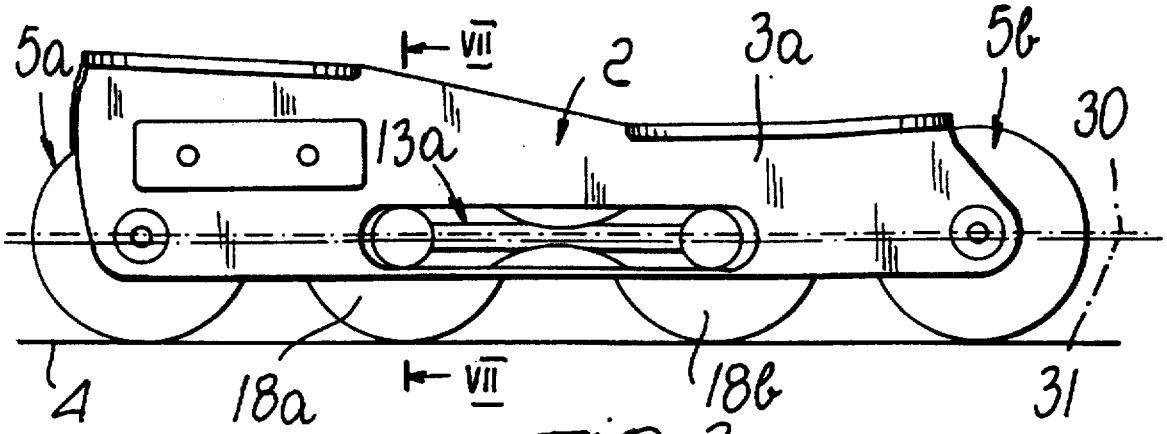
FIG. 3 is a side view of the skate of FIG. 1, with the four wheels arranged in a line so that their axes lie on the same plane of arrangement.
Figure 4:
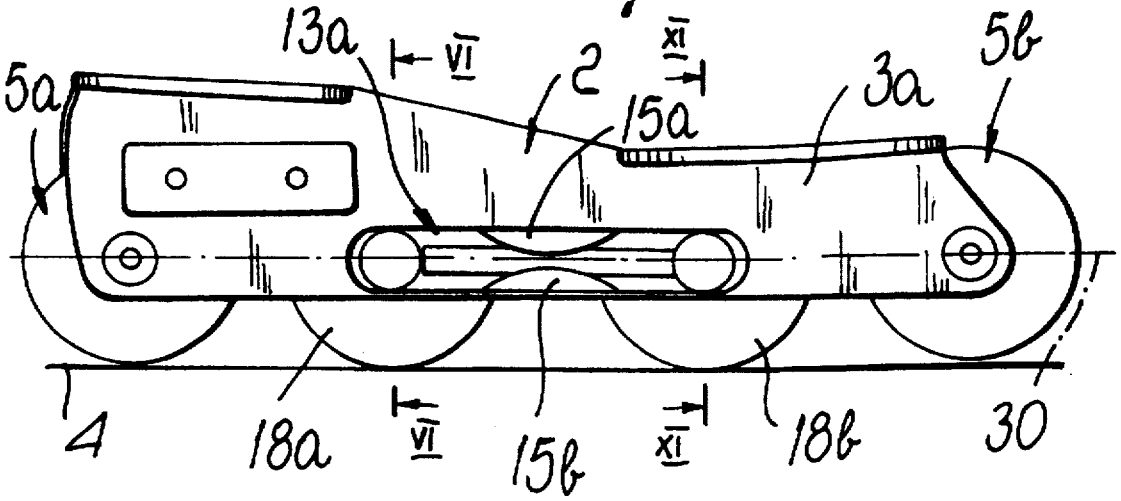
FIG. 4 is a view, similar to FIG. 3, of the skate in the slalom configuration, that is to say, with the two central wheels pivoted on an axis that lies on a plane arranged below the plane of the two first wheels.
Figure 5:
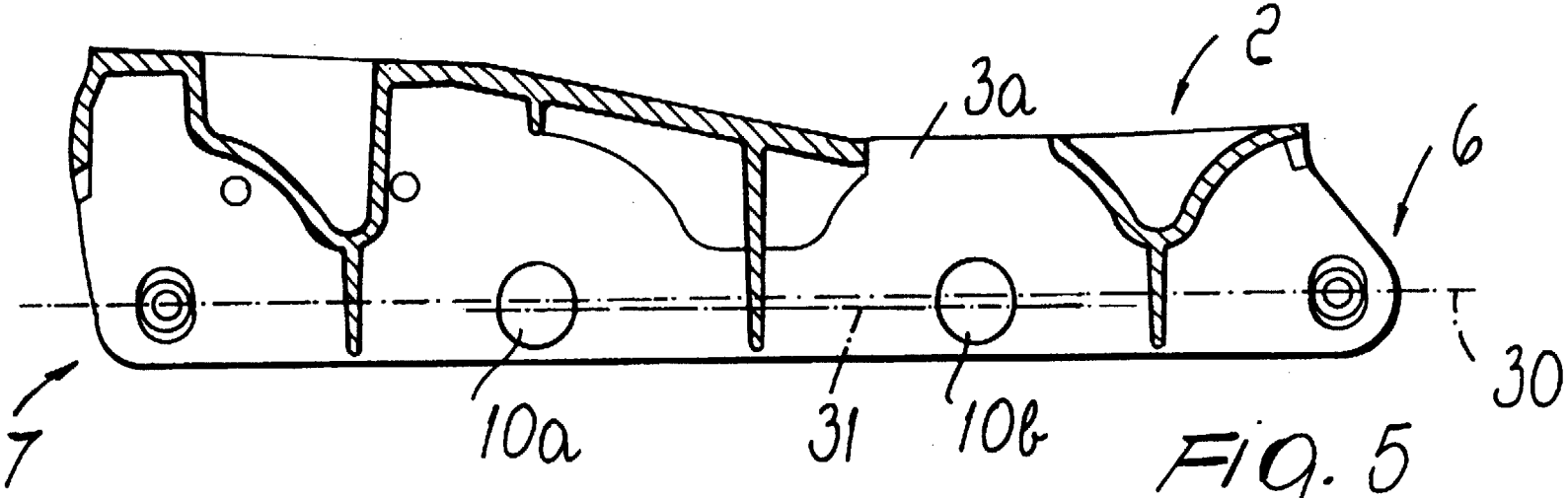
FIG. 5 is a side sectional view of the frame of the skate of FIG. 1, taken along a longitudinal median plane.
Figure 7:
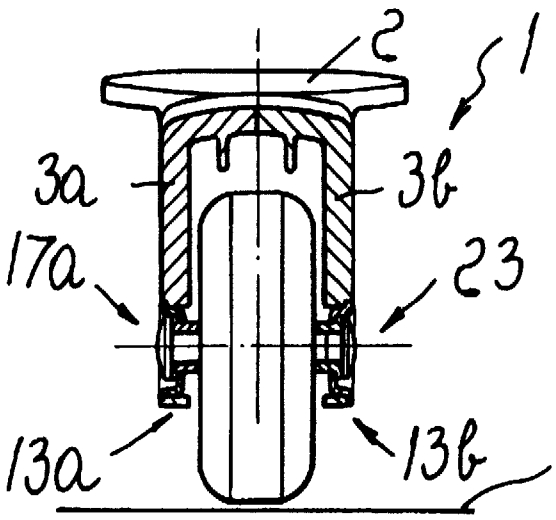
FIG. 7 is a sectional view, taken along the plane VII—VII of FIG. 3.
Figure 6:
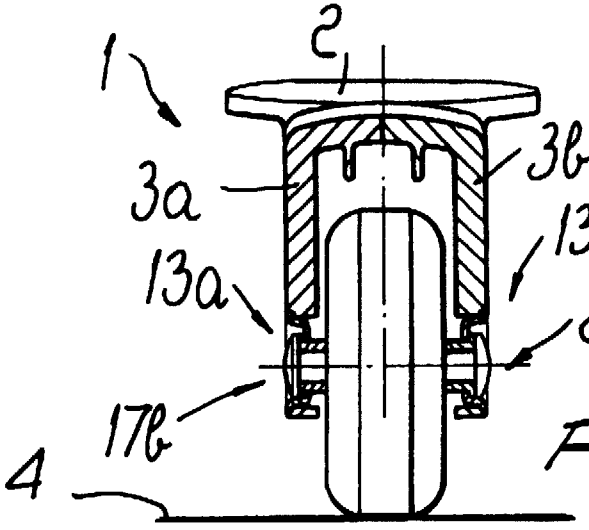
FIG. 6 is a sectional view, taken along the plane VI—VI of FIG. 4.

With reference to the above figures, the numeral 1 designates a skate that is constituted by a U-shaped frame 2 having parallel wings 3*a* and 3*b* that are directed toward the ground 4.

First wheels 5*a* and 5*b* are rotatably mounted to the wings 3*a* and 3*b*, respectively at the rear end 7 and at the front end of skate 1, by means of first pivots 8*a* and 8*b*. Pivots 8*a*, 8*b* are arranged in adapted circular seats formed on the wings and have axes that lie at a common plane 30.

Two first longitudinal seats 9*a* and 9*b* are formed on wings 3*a* and 3*b* and are interposed between front end 6 and rear end 7. The seats are mutually identical and are arranged symmetrically with respect to a generally horizontal median plane that is oriented longitudinally relative to frame 2.

Each one of first longitudinal seats 9a and 9b has an essentially rectangular shape with circularly rounded corners. Two preferably elliptical first holes 10a and 10b are formed at the ends of each longitudinal seat 9a and 9b. These first holes are arranged symmetrically with respect to a generally horizontal median plane that is oriented transversely to each one of the first longitudinal seats 9a and 9b. The median axes that pass through first holes 10a and 10b are located in a plane 31 that is parallel to plane 30 that passes through the axes of first pivots 8a and 8b.

Advantageously, plane 31 is closer to the ground 4.

Each one of first longitudinal seats 9a and 9b has two concave central recesses 11a and 11b formed along longitudinal edges 12a and 12bof each seat 9a and 9b.

Two wheel supports 13a and 13b are selectively associable with each one of first longitudinal seats 9a and 9b. Supports 13a and 13b have shapes which are complementary to, i.e. which conform to, the shapes of longitudinal seats 9a an 9b, whereby supports 13a and 13b can be inserted into seats 9a and 9b.

Each one of supports 13a and 13b has two studs 14a and 14b, proximate to its ends. Studs 14a, 14b are shaped complementarily to first holes 10a and 10b and are formed so as to be arranged axially with respect to first holes 10a and 10b. Each one of supports 13a and 13b has two protrusions 15a and 15b which conform to and are insertable in recesses 11a and 11brespectively.

Figures 8, 9, 10, 11:
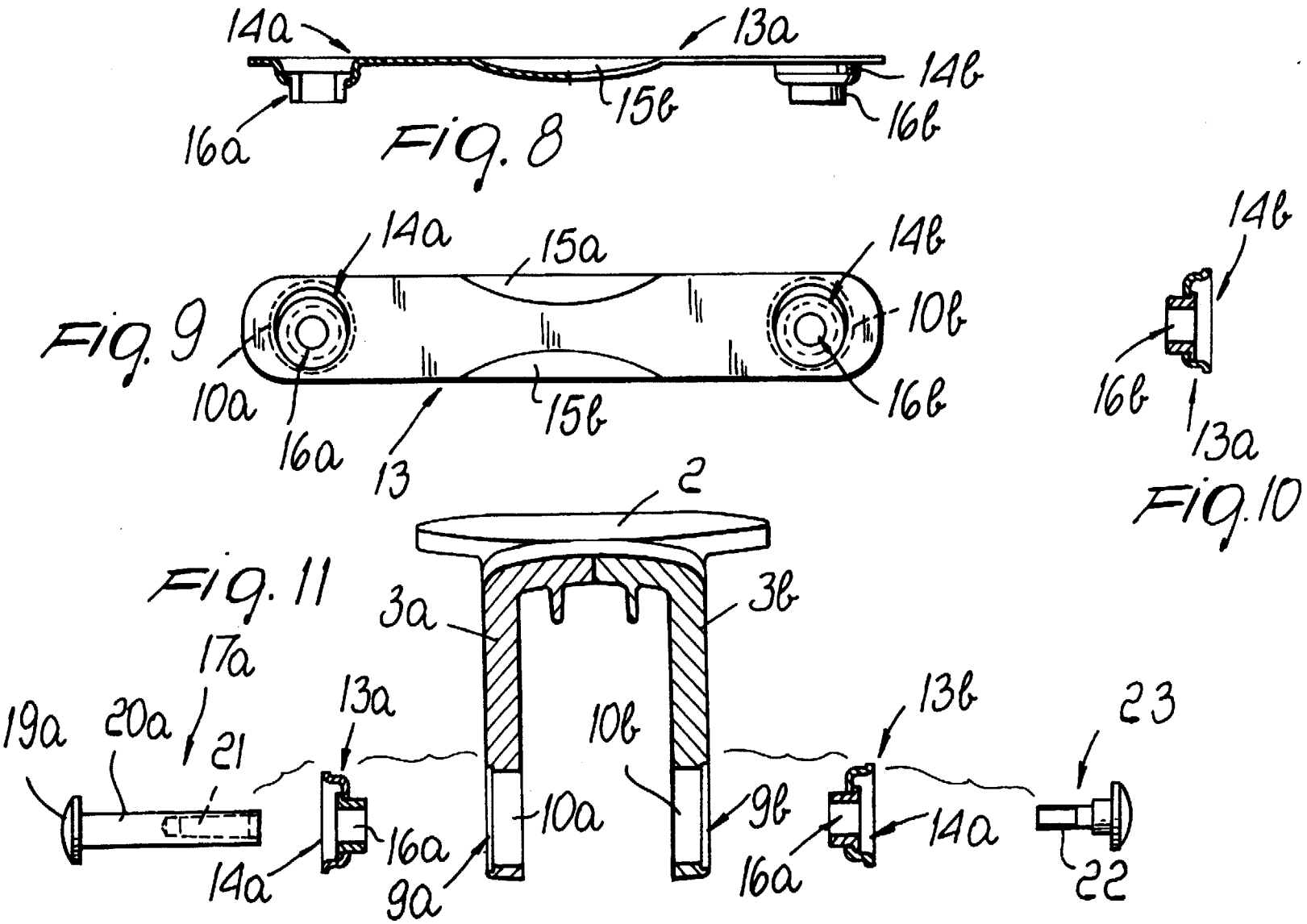
FIG. 8 is a partially sectional top view of a support.
FIG. 9 is a partially sectional side view of the support of FIG. 8.
FIG. 10 is a sectional view, taken along the plane X—X of FIG. 9.
FIG. 11 is an exploded sectional view, taken along the plane XI—XI of FIG. 4.

Two cylindrical bushes 16a and 16b are associated at right angles with studs 14a and 14b; bushes 16a and 116b have axes which are arranged eccentrically with respect to the longitudinal median axes of studs 14a and 14b, as shown in FIG. 9 and 10, and the pair of bushes forms second seats for the insertion of two second pivots 17a and 17b for rotatably mounting two second wheels 18a and 18b.

Advantageously, the staggering or spacing between the axes of the bushes 16a and 16b and the axes of the studs 14a and 14b is equal to the distance between planes 30 and 31.

Bushes 16a and 16b have longitudinal axes that lie in the same plane and can selectively be arranged in the same plane of arrangement 30 for the rotation axes of the first wheels, 5a and 5b when coupling the supports to first seats 9a and 9b.

Each one of second pivots 17a and 17b has a first head 19a and 19b that can be accommodated in a respective of the two studs 14a and 14b. A first stem 20a and 20b protrudes at right angles from each first head 19a and 19b and can be inserted in the two bushes 16a and 16b. First stem 20a and 20b have a common length that corresponds to the width of the pair of wings 3a and 3b of the frame 2.

Each first stem 20a and 20b is provided with a third seat or recess 21 formed axially and on the opposite side in each first stem with respect to first head 19a and 19b. The seat 21 is cylindrical and is internally threaded, and accommodates or receives a complementarily shaped second stem 22 of a respective second pivot 23 that can be associated with or couple to wings 3a and 3b in opposition with a respective of second pivot 17a or 17b.

The operation of the device is as follows: supports 13a and 13b can be positioned in the two first longitudinal seats 9a and 9b according to two different conditions. It is thus possible to arrange bushes 16a and 16b so that their axes lie in the same plane 30 as the rotation axes of first wheels 5a and 5b, and in this manner first wheels 5a and 5b and second wheels 18a and 18b lie in the same plane of arrangement; i.e. are both coplanar and collinear this condition is ideal for using the skate in speed skating.

Otherwise, it is possible to arrange bushes 16a and 16b so that their axes lie in a plane that is arranged below the rotation plane 30 of first wheels 5a and 5b, thus producing a slalom configuration for the skate, that is to say, a configuration in which the rolling surfaces of first wheels 5a and 5b are not in contact with the ground 4.

In this manner, second wheels 18a and 18b are each rotatably mounted about an axis that lies below the rotation axes of first wheels 5a and 5b and thus lie in a plane of arrangement that is below the plane of arrangement 30 of first wheels 5a and 5b.

It has thus been observed that the invention has achieved the intended aim and objects, providing a skate with in-line wheels that can be used both for speed skating and for slalom skating by changing the arrangement of the wheels in a simple and rapid manner by virtue of the possibility of extracting the supports, 13a and 13b rotating them, and reassembling them to the two first longitudinal seats.

In this manner, the two second wheels 18a and 18b can vary their elevation relative to the ground with respect to the two first wheels 5a and 5b by a simple and quick operation.

Furthermore, a different configuration of the skate, for speed or for slalom, is achieved by manipulating only two supports 13a and 13b that are rather large and are thus clearly visible and easy to grip for the user. Furthermore, should these supports slip out of one's hand during their reassembly to the first seats, they are easily recoverable, because of their rather large size.

The correct positioning of the supports is facilitated by their size and by the fact that each one can be inserted in the first seats 9a and 9b from the outside of the wings 3a and 3b of the frame 2 of the skate and not from the inside of the wings.

Furthermore, by positioning one support, 9a and 9b both studs 14a and 14b are positioned identically and thus correctly, eliminating the risk of having, on the same wing, 3a and 3b seats for the central wheels 18a and 18b arranged at different elevations.

In practice, the materials employed, as well as the dimensions of the individual components, may be any according to the specific requirements; thus, for example, the shape of first holes 10a and 10b and of the complementarily shaped studs may be circular, without altering the fact that the median axes that pass through first holes 10a and 10b are arranged at a plane 31 that is parallel to the plane 30 that passes through the axes of first pivots 8a and 8b.

I claim:

1. An in-line roller skate with adjustable wheels, comprising:

a U-shaped frame having a pair of generally parallel wings each provided on an outwardly facing side with a respective longitudinally extending elongate seat including a pair of boles;

two first wheels rotatably mounted between said wings at respective mounting positions disposed at opposite ends of said frame, said seats being provided on said wings between said mounting positions;

two second wheels; and two elongate wheel supports removably inserted in respective ones of said seats for supporting said second wheels on said frame, said supports each having a shape complementary with or conforming to the respective one of said seats, said supports each having a longitudinal axis, said supports each being provided at opposite ends with wheel seats eccentrically disposed with respect to, or offset from, the longitudinal axis of the respective support, said second wheels being rotatably mounted to said wings via said wheel seats, whereby a vertical position of said second wheels relative to said first wheels may be adjusted by removing said second wheels and said supports from said frame, rotating each of said supports 180° about a horizontal axis oriented perpendicularly to the respective longitudinal axis, reinserting said supports in said elongate seats and reattaching said wheels to said frame at said wheel seats.

2. The skate according to claim 1 wherein said wheel seats are disposed in additional holes provided in said supports at opposite ends thereof, said wheel seats protruding from said additional holes, said additional holes having axes being disposed on the longitudinal axes of said supports, said wheel seats having axes offset relative to the axes of said additional holes.

3. The skate according to claim 2 wherein said additional holes are elliptical.

4. The skate according to claim 2 wherein said additional holes are circular.

5. The skate according to claim 1 wherein each elongate seats has a pair of longitudinal edges, each of said elongate seats being provided with two concave recesses centrally disposed along a respective one of said longitudinal edges.

6. The skate according to claim 5 wherein said supports are provided with studs inserted into said holes, each of said supports being provided with a pair of protrusions conforming to and inserted in said recesses.

7. The skate according to claim 1 wherein said supports are plates each being substantially symmetrical relative to the respective longitudinal axis, each of said elongate seats having a generally rectangular shape with rounded corners, each of said seats being generally symmetrical about a respective vertical axis.

8. The skate according to claim 1 wherein said supports are provided with studs inserted into said holes, said wheel seats including cylindrical bushes inserted through said studs, said studs having first axes and said bushes having second axes, said second axes being offset relative to respective ones of said first axes, said second wheels being rotatably mounted to said wings via pivot pins inserted through respective ones of said bushes and said studs.

9. The skate according to claim 8 wherein said pivot pins each include a head and a stem, said stem being inserted in a respective one of said bushes.

10. The skate according to claim 9 wherein said stem is provided with an internally threaded axially located recess or seat, a stem of an additional pivot pin being inserted into said axially located recess or seat.

11. The skate according to claim 8 wherein said supports each have two possible operational orientations relative to said elongate seats, one of said possible operational orientations enabling a disposition of the axes of said bushes in a common plane with rotation axes of said first wheels.

12. The skate according to claim 1 wherein said first wheels have rotational axes disposed in a first plane, the longitudinal axes of said supports being located in a second plane spaced from said first plane.

* * * * *